United States Patent [19]

Krueger et al.

[11] Patent Number: 4,973,932

[45] Date of Patent: Nov. 27, 1990

[54] ELECTRICAL FUSE WITH COATED TIME DELAY ELEMENT

[75] Inventors: David J. Krueger, Arlington Heights; Robert G. Swensen, Mt. Prospect, both of Ill.

[73] Assignee: Littelfuse, Inc., Des Plaines, Ill.

[21] Appl. No.: 447,688

[22] Filed: Dec. 8, 1989

[51] Int. Cl.[5] ..... H01H 85/04; H01H 85/06

[52] U.S. Cl. ..... 337/164; 337/162

[58] Field of Search ..... 337/158, 159, 160, 161, 337/162, 163, 164, 165, 166

[56] References Cited

U.S. PATENT DOCUMENTS 4,308,515 12/1981 Rooney et al. ..... 337/162

4,417,224 11/1983 Ross ..... 337/164

*Primary Examiner*—H. Broome

*Attorney, Agent, or Firm*—Stephen R. Arnold; Russell E. Hattis

[57] ABSTRACT

A fuse comprises a housing filled with arc-quenching material, terminals at the opposite ends of said housing, and a fuse element assembly in the housing connected between the terminals. The fuse element assembly has at least one short circuit blowing section and a center-melting slow blowing section, both disposed within an unpartitioned space in the housing, so that the entire body of arc-quenching material affects the short circuit blowing section of the fuse. The slow blowing fuse section has a surrounding layer of thermoplastic material which prevents the oxidation thereof and becomes plastic at the melting temperature of the time delay element. During the fuse element melting attendant to blowout, plastic deformation allows necessary geometric change in fuse element shape and facilitates collapse of the slow blowing fuse section.

7 Claims, 2 Drawing Sheets

ELECTRICAL FUSE WITH COATED TIME DELAY ELEMENT

DESCRIPTION

Technical Field

The technical field of the invention is the industrial electrical fuse art.

BACKGROUND OF THE INVENTION

One common form of an industrial fuse comprises a cylindrical housing having an axial central passage therethrough divided by partitions into three compartments or chambers. Disposed within the outer compartments are axially spaced short circuit blowing fuse elements, interconnected by a central slow blowing fuse element located in the central compartment. The slow blowing fuse element is generally made of low temperature melting alloy, such as solder, which melts well below 1000° F. unlike, for example, copper alloy fuse elements. The slow blowing fuse referred to is one which will blow because the fuse element material itself reaches a melting point where it melts, collapses and opens the circuit. This type of slow blowing fuse, to be referred to as a center melting fuse, is to be contrasted with a diffusion-type slow blowing fuse wherein the basic fuse element material diffuses under heat into a metal adjacent to it so that it produces a new fuse alloy which in turn can blow and open the circuit under prolonged overloads. The outer compartments are filled with a granular arc-quenching material like sand for reasons to be explained, but the center compartment is not. Cylindrical end caps are secured over the ends of the housing to complete the assembly.

The fuse structure thus provides for immediate blowout under short circuit conditions where current many times the rated fuse current passing through the structure will melt one or both of the short circuit fuse elements. The arc-quenching material quickly quenches the arc which initially develops during short circuit conditions, so that the fuse immediately opens to protect the circuit involved and to avoid a dangerous explosion of the fuse housing.

On the other hand, slow blowing fuse elements are designed to pass moderate overload current surges in excess of the rated value for a brief period of time without blowing. Such a delay characteristic, for example, is particularly desirable in case of fuses designed for use with electric motors and other electrical loads having momentary high startup currents.

Current industrial safety standards demand that a slow blowing fuse element must blow at 135% of its "rated" value under prolonged load. Thus, a fuse rated at 15 amperes is required by these standards to blow at 20.25 amperes within one hour. These standards specify lesser periods of time at current ratings of 200% and 500% of rated current. The time delay is achieved by making the mass and resistance of the time delay element such that during passage of these various currents above rated values the temperature of the element will rise to its melting temperature with a desired delay and within the designated time period. The relevant factors to be taken into consideration in producing a desired delay are the resistance of the element, its length, its cross-sectional area, and the heat leakage rate from the time delay element to the surrounding environment. Thus, the various parameters of the slow blowing fuse element may be adjusted to provide the desired operating conditions of the fuse.

A further constraint posed by current safety standards is that the housing must not undergo explosive rupture from the overpressures generated attendant to short-circuit blowout, where short currents can reach hundreds of thousands of amperes. In the absence of special measures taken to minimize the effects of such overpressure, this typically mandates a large housing having very thick walls. On the other hand, a continuing design objective is the reduction in the size of fuse assemblies. To achieve non-rupturing fuse assemblies in housings of minimum dimension, a common recourse is to add the granular arc-quenching material surrounding the short circuit blowing elements. Such material may be made from a variety of substances. In addition to providing a large surface area facilitating free electron recombination in the expanding arc, thereby reducing the extinction voltage, certain filler materials are also believed to evolve electronegative gases with a similar ability to capture free electrons. The captured electron, now affixed to a much higher mass, is no longer effective in sustaining the discharge. Arc-quenching filler materials used for such purposes are well-known in the art, and include silica, boric acid, and fuller's earth.

As previously indicated, it has been customary to divide the fuse housing into separate compartments for the short circuit blowing and slow blowing fuse elements, so that the arc-quenching material is retained only in the outer compartments, leaving the slow blowing fuse element free of such materials.

SUMMARY OF THE INVENTION

It was believed that the cost, complexity and size of the industrial fuse above described could be materially reduced without effecting the reliability and safety of the fuse by eliminating the partitions in the fuse housing and by filling the entire fuse housing with arc-quenching material. Thus, the volume of arc-quenching material surrounding the center-melting slow blowing fuse element would also be useful in preventing buildup of dangerous arcs and pressure conditions under short-circuit blowing conditions. It was found, however, that especially when the slow blowing fuse element was surrounded by arc-quenching material, the reliability of the center-melting slow blowing fuse was adversely affected, particularly when the slow blowing fuse element was of a very short length desired for reduced housing size. Thus, when the size of the slow blowing fuse element was reduced materially, it was discovered that the fuse element supported by the arc-quenching material did not collapse and open on prolonged modest overload, even though it became molten. It was determined that the failure of the slow blowing fuse element to collapse was due to an oxide coating which formed a sufficiently strong sheath around the fuse element; therefore, when it melted the fuse material did not flow and collapse especially when it was surrounded and supported by a body of arc-quenching material.

Accordingly, it is one of the features of the present invention to provide a fuse of greatly reduced size and of the type which has at least a short circuit blowing section and a slow blowing fuse section connected in series between a pair of fuse terminals, and wherein arc-quenching material useful for short circuit blowing conditions surrounds the slow blowing fuse element, as well as the short circuit blowing fuse element or elements. The volume of the arc-quenching material around the slow blowing fuse element is also effective in quenching the arc and avoiding conditions which would explode the fuse upon short circuit conditions. This permits the fuse housing to be materially reduced in size. In one example of the present invention a reliable fuse is provided having a housing size of only $1\frac{1}{2}'' \times 13/32''$ which is capable of reliably interrupting as much as 200,000 amperes in 600 volt low power factor circuits, while providing sufficient time delay for startup current of across-the-line industrial motors. It was found, however, that this reduction could not be obtained without adversely affecting the reliable operation of the center-melting slow blowing fuse element, unless the slow blowing fuse element was coated with a thermoplastic material which seals the surface of the fuse element against exposure to oxygen. The thermoplastic material is chosen so that it has a significant plasticity in the vicinity of the melting temperature of the slow blowing fuse element. When the slow blowing fuse element melts, the surrounding softened thermoplastic matrix will also yield as the fuse element melts to change its geometry to a circuit-breaking shape. The surrounding arc-quenching filler material does not then effectively act as a confining support, preventing such geometrical changes. Thus, this invention allows the entire fuse housing, including the central delay element, to be filled with arc-quenching material, eliminating the need for compartment-forming partitions, resulting in a much smaller, lower cost fuse.

The fuse of the present invention is not the first fuse which included short circuit blowing and slow blowing fuse sections connected in series in a housing space which was not partitioned, and wherein the entire fuse housing was filled with an arc-quenching material. One such uncommon prior art fuse is shown in U.S. Pat. No. 4,417,224, granted Nov. 22, 1983. A commercially available fuse made by the assignee of this patent which resembles the fuse shown in drawings of this same patent has a housing of a length of about 3". However, the slow blowing fuse element of this fuse is of the diffusion-type, and is not believed to be coated with a thermoplastic material as described. Thus, designers of these fuses do not appear to have appreciated that the size of the fuse involved could be materially reduced by utilizing the space around the slow blowing fuse element to hold the arc-quenching material using a center-melting slow blowing fuse generally shortened in length and coated with a thermoplastic material as described, without significantly sacrificing fuse reliability.

Other features and advantages of the invention will be apparent from the following specification taken in conjunction with the following drawings.

DESCRIPTION OF INVENTION

Figure 1:
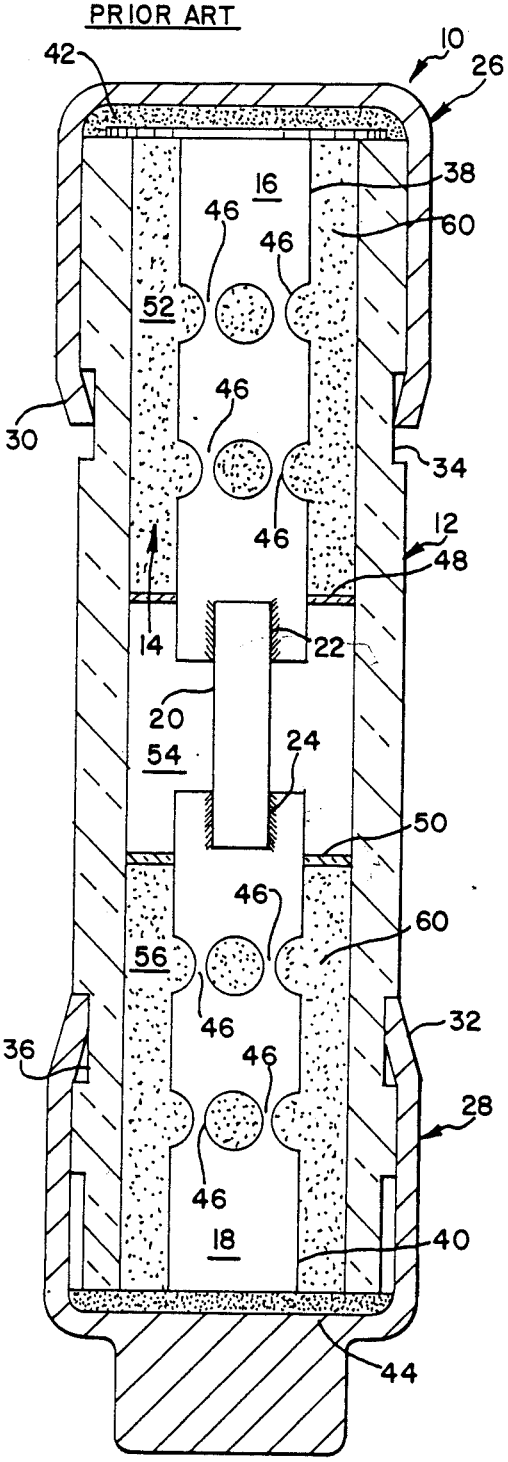
FIG. 1 PRIOR ART
FIG. 1 is a partial cross-section view of a prior art fuse having short circuit blowout elements and a time delay element.

FIG. 1 (not to scale) shows a common prior art industrial fuse assembly 10. The fuse assembly 10 comprises a cylindrical housing 12 having an axial central passage 14 therethrough. Disposed within the central passage 14 is a fuse element assembly consisting of short circuit blowing coplanar plate-shaped elements 16,18 spaced a short distance apart and interconnected by a central slow blowing fuse element 20 lying on end faces of the short circuit fuse elements, the three elements 16,18,20 being fusingly joined together by fillets 22,24. Terminal caps 26,28 are secured over the ends of the housing 12, their respective cap ends 30,32 being crimped into annular upper and lower housing grooves 34,36 respectively. Mechanical and electrical connection between the outer ends 38,40 of the upper and lower short circuit blowing elements 16,18 is secured by means of solder pools 42,44.

In the structure shown in FIG. 1, rapid blowout under extremely high current is achieved by making the fuse elements 16,18 of relatively high melting point material, but having constrictions 46-46 disposed therein. Under short circuit conditions, the upper and lower elements 16,18 will immediately heat to the melting point in the vicinity of their associated constrictions 46-46, resulting in immediate blowing of the fuse assembly 10. The resistance, mass, composition and geometry of the central slow blowing fuse element 20 is chosen so that it does not respond immediately to instantaneous surges moderately above the rated current, provided that their duration is not too long. This provides the desired time delay feature.

Partitions 48,50 are placed proximate to the ends of the slow blowing fuse element 20, thereby dividing the interior of the housing 12 into successive chambers 52,54,56 respectively. The chambers 52,56, but not the central chamber 54, are filled with arc-quenching material 60 during the fuse assembly.

Figure 2:
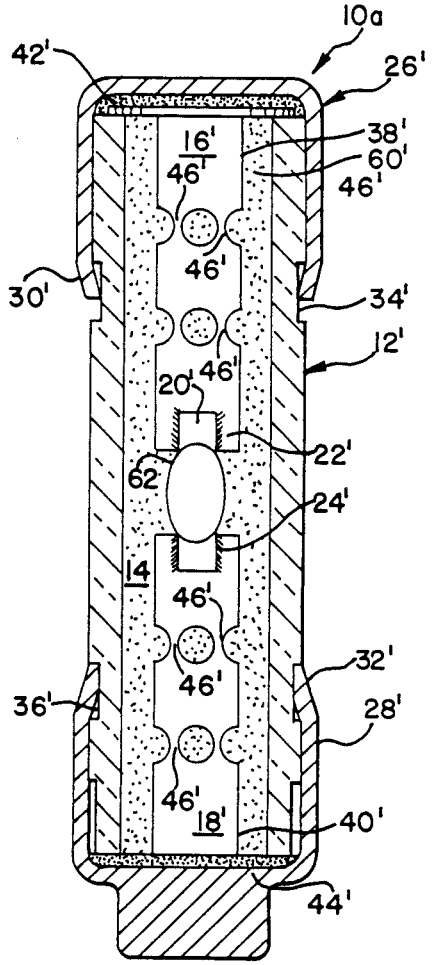
FIG. 2 is a partial cross-section view of a fuse similar to that of FIG. 1 showing a coated time delay element.
Figure 3:
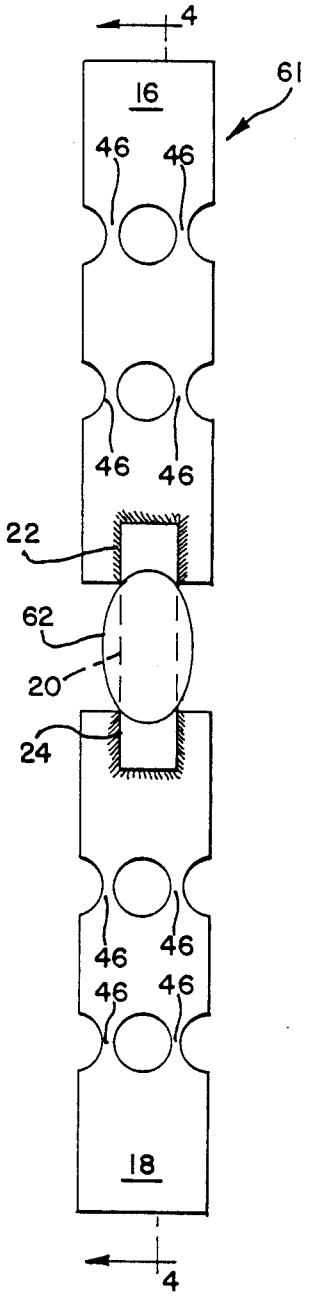
FIG. 3 is a plan view of the central fuse element structure of the fuse of FIG. 2.
Figure 4:
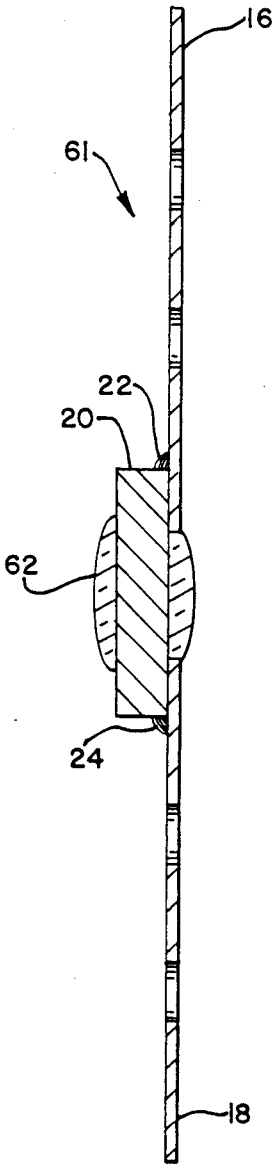
FIG. 4 is a cross-section view of the fuse element structure shown in FIG. 3, the cut being taken as indicated by the cut lines 4—4 thereon.

FIGS. 2, 3, and 4 show a modified fuse 10*a* similar to that shown in the prior art fuse 10 of FIG. 1, except that it is of much smaller size, has no spacers 48,50, so that the arc-quenching material 60' occupies the entire central passage 14' of a much smaller fuse housing 12', and a center-melting slow blow fuse element with a thermoplastic coating as described. The corresponding elements in the fuse of FIG. 2 have been numbered similarly to the corresponding elements of the fuse shown in FIG. 1, except that primes have been added to the numbers in FIG. 2. The present invention has a markedly reduced size because of the features of the invention now to be described.

The short circuit blowing elements 16',18' are both preferably made of planar stock gilding metal alloy (copper/zinc). The relevant size of the elements shown in FIGS. 3 and 4 are approximately to scale with respect to each other. The commercial 15 amp rated fuse of the invention has a center-melting slow blowing fuse element 20 having a diameter of about 0.060" and a length of 0.270". It has a solder-like alloy composition of 18.2% cadmium, 30.6% lead, and 51.2% tin having a flux core and a melting point of 294° F. The ends of the slow blowing fuse element 20' are fused to the confronting ends of the short circuit blowing elements 16',18' by induction heating forming fillets 22,24'.

The central portion of the slow blowing fuse element 20' is provided with a coating 62 of thermoplastic material. The material must be chosen so that it has a reasonably low viscosity at the melting temperature of the fuse. If such is the case, upon melting of the central element 20', it will be surrounded by a fluid phase of thermoplastic material, thereby allowing the molten portion of the central element 20' and the coating 62 to be mobile with respect to each other.

The melting of the slow blowing fuse element 20' under the influence of overload currents passed therethrough arises because a hot spot, typically at the very center of the element, forms causing local melting proceeding from the middle of the time delay element and proceeding to expand thereafter towards the ends. Surface tension forces will attempt to cause necking to occur at the hot spot, and since the element 20' is essentially incompressible, swelling will occur on either side of the necked portion.

Without the coating 62, such swelling would be constrained by a surrounding oxide coating supported by the arc-quenching material; however, since the coating 62 is now reasonably mobile, the necking and swelling of the element 20' is compensated for by relocation of molten thermoplastic material. This presumably can occur without significant change in the outer dimensions of the coating 62, as a result of which the constraining effects of densely packed arc-quenching material 60' appears to have minimal effect on the blowing properties.

In the commercial form of the fuse shown in FIG. 2 having a 15 amp rating, the spacing between the confronting edges of the coplanar plate-like short circuit blowing fuse elements 16',18' was 0.145". The importance of coating the slow blowing fuse element 20' with a material like the thermoplastic coating 62 becomes of exceeding importance because if an oxide coating were to buildup on such a short fuse blowing element, it could have a major effect on the ability of that fuse element to collapse upon the desired temperature conditions.

The thermoplastic material used for the coating 62 may take a variety of forms; however, one material particularly useful for the particular fuse under discussion is type 3748 made by Minnesota Mining Co., Minneapolis, Minnesota, a thermoplastic material made of solvent-free thermoplastic resins and having a "softening temperature" (A.S.T.M. Specification E-26-6-7) of 292° F., a flame-induced ignition temperature of 536° F. and an auto ignition temperature of 626° F. Such a coating may be applied to the structures shown in FIGS. 3-4 by a variety of methods. One simple method is to dispense the thermoplastic material from a heated reservoir vessel having a heated nozzle therebelow dispensing the molten plastic directly on the fuse element 20' while the entire structure is rotated about its lengthwise axis. A representative buildup of such material 62 on the central element 20' would be a layer having a thickness of approximately 0.060 inches. The application of such coatings has been shown to stabilize the long-term aging characteristic of such fuses. Appropriate combinations of thermoplastic material and delay elements of various alloy compositions for securing the above-mentioned approved fuse properties will be evident to those skilled in the art and are to be construed as being within the scope of the claimed subject matter. Additionally, mild reducing agents may be incorporated into the thermoplastic material to further inhibit the slag formation; however, care must be taken that these reducing agents do not produce long-term corrosive effects in prolonged service.

While the invention has been described with reference to a preferred embodiment, it will be understood by those skilled in the art that various changes may be made and equivalents may be substituted for elements thereof without departing from the broader aspects of the invention. Also, it is intended that broad claims not specifying details of a particular embodiment disclosed herein as the best mode contemplated for carrying out the invention should not be limited to such details. Furthermore, while, generally, specific claimed details of the invention constitute important specific aspects of the invention in appropriate instances even the specific claims involved should be construed in light of the doctrine of equivalents.

We claim:

1. In an electrical fuse having a housing, a center-melting slow blowing first fusible element in said housing which is to blow after passage of a given overload current for a given period of time, said element having a given melting temperature substantially less than 1000° F., terminal means on said housing for making electrical connection between the ends of said first element and external circuitry, and a quantity of granular arc-quenching material in said housing surrounding said first element, said first element being made of a material oxidizable in the solid state to form a surface coating substantially confining movement of the liquid phase of said material against said arc-quenching material upon melting, the improvement comprising:

a coating of thermoplastic material adhered to the surface of said first element in the hottest-running region thereof for substantially sealing the same against exposure to surrounding gases, so as to prevent oxidation of said surface, said coating having a given softening temperature so as to flow at said given temperature so as not to significantly hinder the flow and blowout-causing collapse of said first element while said overload current flows for said given period of time.

2. An electrical fuse having a housing, axially spaced terminal means on said housing for making electrical connection to external circuitry, a fuse element assembly connected between said terminal means, said fuse element assembly comprising at least one short circuit blowing section axially spaced from and electrically connected in series with a center-melting slow blowing fuse section, said slow blowing fuse section blowing after passage of given overload load current for a given period of time, the improvement comprising:

the interior of said housing containing said short circuit and slow blowing fuse elements being unpartitioned to form single housing space, a body of arc-quenching material filling said space and surrounding both the short circuit and slow blowing sections of the fuse; and a coating of thermoplastic material adhering to the surface of such slow blowing fuse element at least in the hottest-running region thereof for substantially sealing the same against exposure to surrounding gases, so as to prevent oxidation of such surface, such coating having a given softening temperature so as to flow at a given temperature so as to not significantly hinder the flow of molten fuse element material, to permit collapse of such slow blowing fuse element at said given overload current flowing for said given period of time.

3. The fuse of claims 1 or 2 wherein said fuse has a pair of said short circuit blowing elements connected to opposite ends of said slow blowing fuse element, said arc-quenching material surrounding all of said fuse elements.

4. The fuse of claims 1 or 2 wherein said thermoplastic material is a thermoplastic resin.

5. The fuse of claims 1 or 2, wherein said slow blowing fuse element is made of a lead-tin alloy.

6. The fuse of claim 3, wherein said short circuit blowing fuse elements are closely spaced, substantially coplanar plate-like elements having opposite flat faces, said slow blowing fuse element being a body of fuse element material spanning the short space between and secured upon the corresponding faces of said plate-like elements.

7. The fuse of claims 1 or 2 wherein said housing has a length of substantially under 2", is capable of reliably of operating in 600 volt low power factor circuits and in series with across-the-line industrial motors, and interrupting short circuit currents of hundreds of thousands of amperes.

* * * * *